US005456463A

United States Patent [19]

Dolan et al.

[11] Patent Number: 5,456,463

[45] Date of Patent: Oct. 10, 1995

[54] HOCKEY STICK WITH ERGONOMIC HANDGRIP

[76] Inventors: Michael J. Dolan; Thomas Dolan, both of c/o Michael Dolan Industrial Design, 31 Union Square West, 2A, New York, N.Y. 10003

[21] Appl. No.: 311,676

[22] Filed: Sep. 23, 1994

[51] Int. Cl.[6] ..... A63B 59/14

[52] U.S. Cl. ..... 273/67 A

[58] Field of Search ..... 273/67 A, 72 R, 273/72 A, 730, 75, 81.4, 67 R

[56] References Cited

U.S. PATENT DOCUMENTS

| | | | |
|---|---|---|---|
| D. 182,359 | 5/1958 | Doughty . | |
| D. 251,861 | 5/1979 | Carbonero . | |
| 2,843,384 | 10/1955 | Schmidt . | |
| 2,962,288 | 11/1960 | Lowden . | |
| 3,940,134 | 2/1976 | Bregnowski | 273/67 A |
| 4,052,059 | 10/1977 | Rigsby | 273/67 A |
| 4,351,528 | 9/1982 | Duplin | 273/67 A |
| 4,361,325 | 11/1982 | Jansen . | |
| 4,553,753 | 11/1985 | Gibbons . | |
| 4,934,024 | 6/1990 | Sexton, I . | |
| 5,263,711 | 11/1993 | Addis et al. | 273/67 A |
| 5,299,802 | 4/1994 | Bouchet-Lassale . | |

FOREIGN PATENT DOCUMENTS

| | | | |
|---|---|---|---|
| 1159485 | 12/1983 | Canada | 273/67 A |

*Primary Examiner*—Mark S. Graham
*Attorney, Agent, or Firm*—William E. Pelton

[57] ABSTRACT

A goalie hockey stick includes a blade and a shaft joined at a heel, the shaft including a widened shaft portion and a narrow handle portion. An ergonomic handgrip is formed between the widened shaft portion and the handle portion. The handle portion is offset from the widened shaft portion to enable the lower surface of the handle portion to be close to but spaced from the playing surface when the hockey stick is held in a horizontal position against the playing surface such that a puck is prevented from sliding thereunder, but the gloved fingers of the goalie can grip anywhere on the shaft or the handle. An endcap is formed at the end of the shaft to offset the weight of the blade and has a stop portion to maintain a predetermined distance between the lower surface of the handle portion and the playing surface when the hockey stick is held in a horizontal position against the playing surface. The hockey stick is graphically treated to conceal the visible position of the blade during play.

19 Claims, 4 Drawing Sheets

HOCKEY STICK WITH ERGONOMIC HANDGRIP

BACKGROUND OF THE INVENTION

The present invention relates generally to the field of hockey sticks, and, more specifically, to the field of goalie sticks.

Conventional hockey sticks generally are formed in an L-shape with two portions: an elongated shaft and a blade, both joined at a heel. For a goalie stick, the shaft generally has a greater width at the heel end than at the opposite end. The dimensions of professional hockey sticks are promulgated by the governing bodies of the various hockey leagues, such as the National Hockey League ("NHL"). According to NHL rules, the length of the shaft of a goalie stick shall not exceed 58 inches and the length of the blade shall not exceed 15½ inches. The width of the blade must not exceed 3½ inches except at the heel, where it must not exceed 4½ inches. The width of the shaft at the widened portion near the heel must not exceed 3½ inches, and the length of the widened portion must not exceed 26 inches from the heel. The widened portion is intended to increase the goalie's ability to block the puck.

Several modifications have been proposed for players' hockey sticks. For example, in U.S. Pat. No. 4,553,753 (Gibbons), an angular grip attached to an end of the shaft of a hockey stick is proposed. In U.S. Pat. No. 5,263,711 (Addis et al.), an adjustable blade and sliding hand grip are proposed for a hockey stick that can be used by both left-handed and right-handed players. Similarly, U.S. Pat. Nos. 3,940,134 (Bieganowski) and 4,052,059 (Rigsby) describe adjustable handles for player' hockey sticks. None of these modifications, however, address the special problems associated with goalie hockey sticks.

More specifically, the conventional design of the shaft of a goalie stick includes a generally rectangular cross-section that makes it difficult for the goalie to comfortably grasp the stick. This design feature causes unnecessary fatigue in the hand and wrist of the goalie.

Furthermore, although a portion of the goalie shaft is widened to prevent the puck from entering the goal when the shaft of the stick is brought toward the playing surface, the puck is still able to enter the goal by passing under the portion of the shaft that is not widened. U.S. Pat. No. 4,544,157 (Curtis) describes a goalkeeper's hockey stick having a bent shaft that can rest flush against the surface of the playing surface. Such a design, however, is impractical because the goalie is unable to grip his or her fingers around the upper portion of the shaft while the stick is resting flush against the playing surface.

OBJECTS AND SUMMARY OF THE INVENTION

Accordingly, it is an object of the present invention to solve the above-described problems encountered with the prior art.

More specifically, it is an object of the present invention to provide a goalie hockey stick with an ergonomic handgrip for ease of handling.

Another object of the present invention is to provide a goalie hockey stick with a shaft that rests close to the playing surface when the stick is in a horizontal position, to prevent the passage of a puck thereunder, but to provide sufficient clearance for the goalie to grip the shaft of the stick.

Still another object of the invention is to provide a goalie hockey stick with an over-sized cap on the end of the shaft to prevent the stick from slipping from the goalie's grip and to provide a measured spacing of the shaft from the playing surface when the stick is in a horizontal position.

Still another object of the present invention is to provide a goalie hockey stick having graphic treatment to camouflage the stick.

According to one aspect of the present invention, a goalie hockey stick includes a blade and a shaft, the shaft comprising a widened portion and a narrow portion with an ergonomic handgrip formed therebetween.

According to another aspect of the present invention, the narrow portion of the shaft is offset from the widened portion of the shaft, such that the narrow portion is close to but spaced from the playing surface by a predetermined amount when the stick is in a horizontal position on the playing surface.

According to still another aspect of the present invention, the goalie hockey stick has an oversized end-cap to prevent the stick from slipping from the goalie's grip and to space the shaft from the playing surface by a predetermined amount to enable the stick to be more easily picked up by the goalie.

According to still another aspect of the present invention, the goalie hockey stick is graphically treated so that the blade is light colored and the shaft is dark colored so that the visible position of the blade is indeterminate.

The above and other objects, features, and advantages of the present invention will become apparent from the following detailed description of the preferred embodiment thereof to be read in conjunction with the accompanying drawings.

BRIEF DESCRIPTION OF THE DRAWINGS

For a further understanding of the present invention, reference may be had to the accompanying drawings in which.

DETAILED DESCRIPTION OF THE PREFERRED EMBODIMENT

Figure 1:
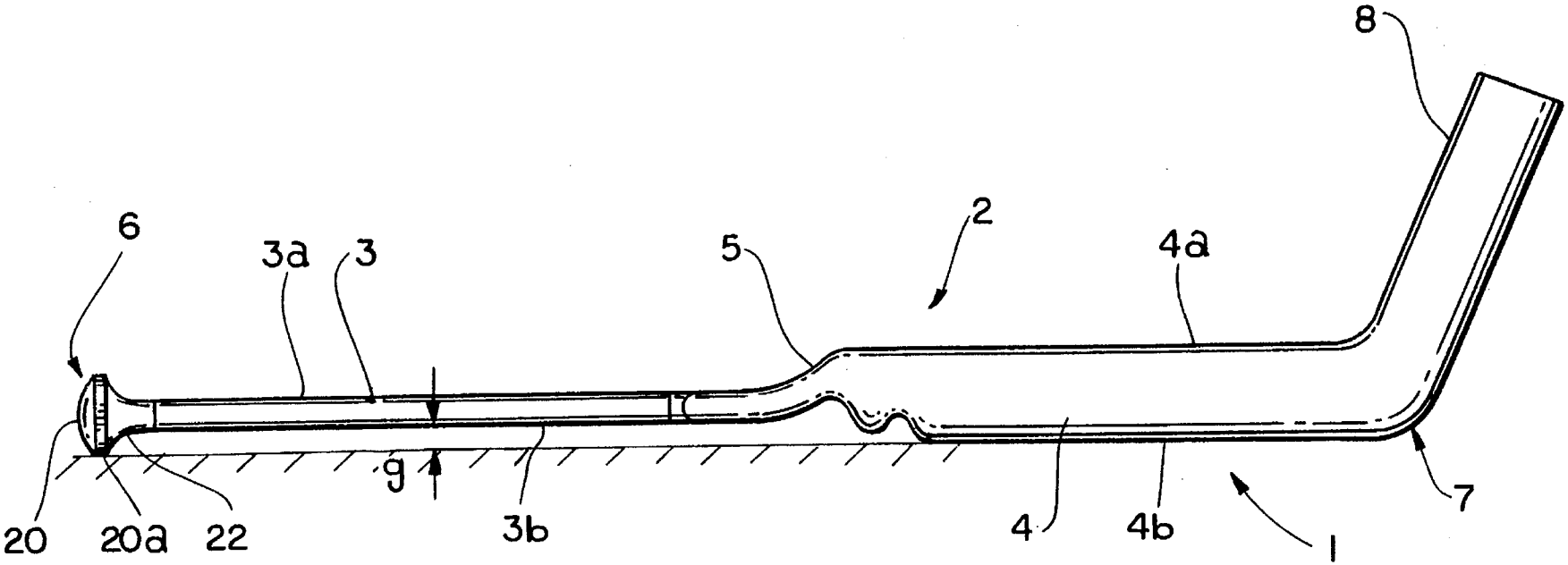
FIG. 1 is a horizontal side view of the hockey stick according to the present invention.

The hockey stick 1 shown in the drawings is a hockey stick intended to be used by a goalie in the game of hockey.

The hockey stick 1 has a general L-shape, as shown in FIG. 1, including a shaft 2 and a blade 8 joined at a heel 7. The shaft 2 has two portions: a narrow handle portion 3 and a widened shaft portion 4. A handgrip 5 is formed between the narrow handle and the widened shaft portions. An endcap 6 is attached at the end of the handle portion 3.

As shown in FIG. 1, the hockey stick 1 is shaped such that the widened shaft portion 4 of the shaft 2 has a width substantially equal to the width of the blade 8. The handle portion 3 has a width less than the width of the widened shaft portion 4.

In FIG. 1, the hockey stick 1 is shown in a horizontal position. As can be seen, the longitudinal axis of the handle portion 3 is offset from the longitudinal axis of the widened shaft portion 4, such that the axis of the handle portion 3 is closer to one edge surface of the widened shaft portion 4 than to the opposite edge surface thereof and thus is closer to the playing surface than is the axis of the widened shaft portion 4 when the hockey stick is on the playing surface. In the preferred embodiment, the offset is such that the longitudinal axis of the widened shaft portion 4 substantially corresponds with the upper edge 3*a* of the handle portion 3. A gap g of a predetermined dimension is formed between the lower edge 3*b* of the handle portion 3 and the playing surface when the hockey stick 1 is in the horizontal position as shown. In this position, the lower edge 4*b* of the widened shaft portion 4 is flush against the playing surface and the blade 8 is inclined at an angle with respect to the playing surface.

Figure 2:
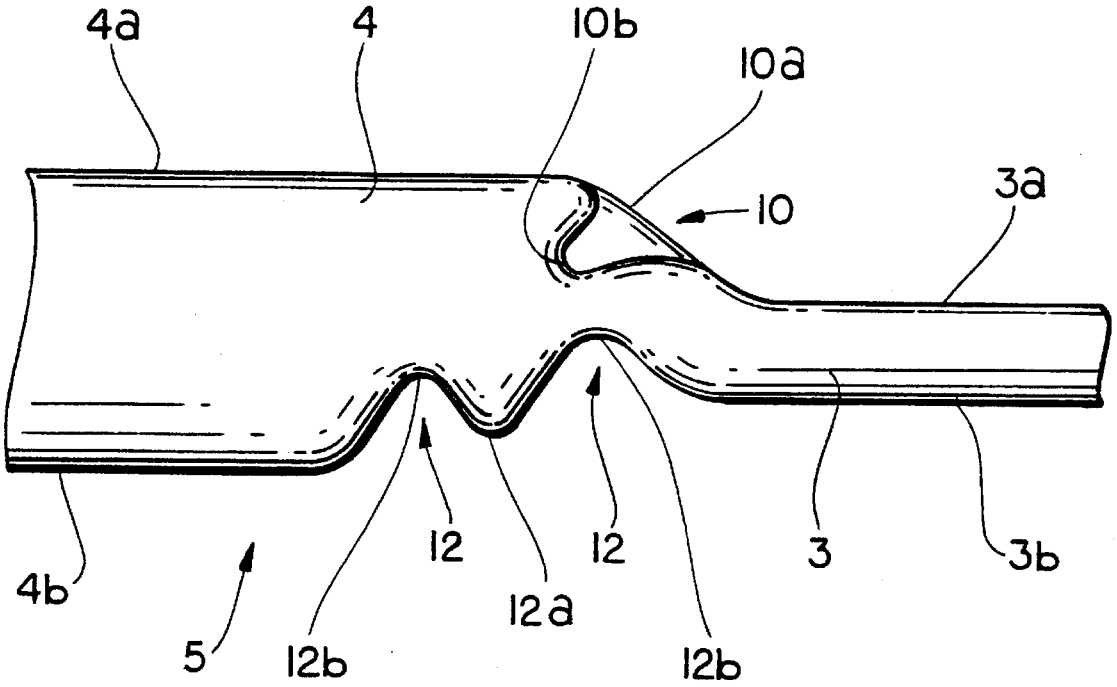
FIG. 2 is partial side view of a rear side of the ergonomic handgrip of the hockey stick shown in FIG. 1.

The handgrip 5 will now be described in greater detail with reference to FIGS. 2 and 3. As shown in FIG. 2, the handgrip 5 has an ergonomic shape, including an indented thumb portion 10 and a pair of adjacent finger portions 12. In the preferred embodiment, the finger portions 12 are formed as inwardly directed, adjacent notches formed along the lower edge surface of the shaft 2 along a downwardly inclined plane between the lower edge 3*b* of the handle portion 3 and the lower edge 4*b* of the widened shaft portion 4. Each finger notch 12 is substantially V-shaped and defined by a smoothly curved surface area the radius of curvature of which varies so that each notch narrows at a rounded inner peak 12*b*. The curved surface area defining the notches 12 also forms a rounded promontory 12*a* between them. Lines bisecting each notch preferably tend to converge at a point in space beyond the upper edge surface of the shaft 2. The inner peaks 12*b* extend inwardly into the shaft 2 from below the center longitudinal axis of the widened shaft portion 4. In the preferred embodiment a line tangential to the peaks 12*b* is oblique to the axis of the shaft 2 on a downward incline.

The thumb portion 10 is an indentation formed on at least one side surface of the shaft 2 at an upwardly inclined upper surface area 10*a* extending from the upper edge 3*a* of the handle portion 3 to the upper edge 4*a* of the widened shaft portion 4. The thumb portion 10 may consist of a pair of indentations formed on opposite sides of the shaft 2, as desired. The indentation 10 is substantially triangular in shape having a base side aligned with the inclined upper surface area 10*a* and a rounded point 10*b* opposite the base side. This configuration enables the goalie's hand to be comfortably and firmly wrapped around the hockey stick 1 with the thumb fitting in the thumb portion 10 and a finger fitting in each of the finger portions 12.

Figure 3A:
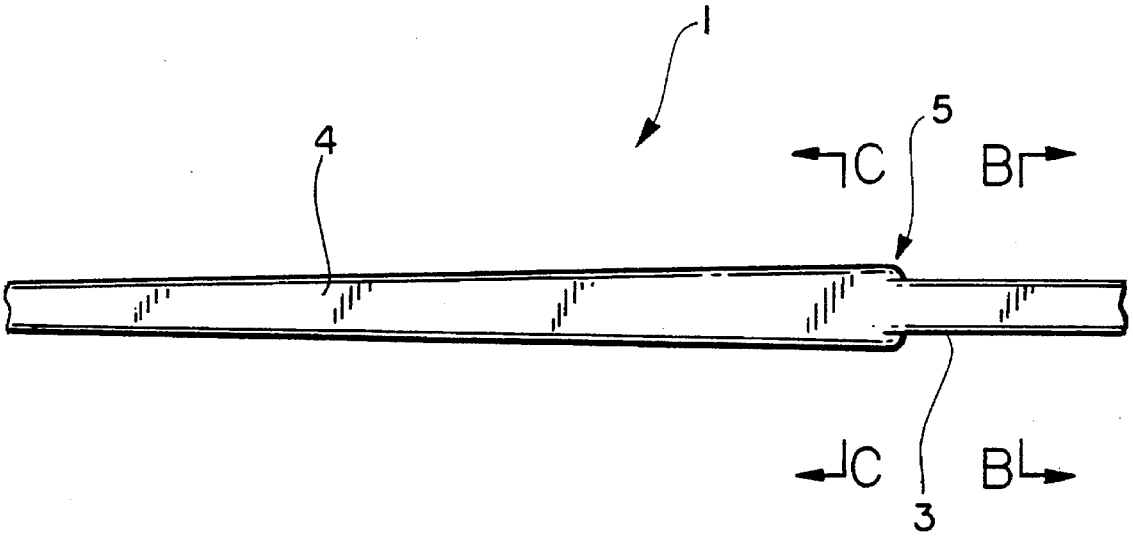
FIG. 3A is a partial top view of the handgrip section of the hockey stick shown in FIG. 1.
Figure 3B:
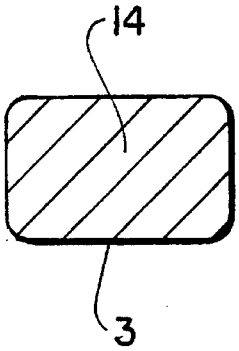
FIG. 3B is a cross-sectional view along lines B—B of FIG. 3A.
Figure 3C:
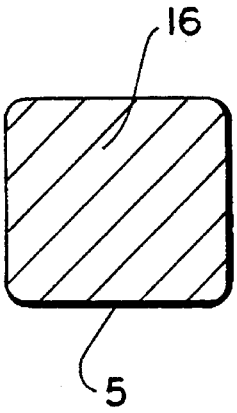
FIG. 3C is a cross-sectional view along lines C—C of FIG. 3A.

As can be seen in the embodiment of FIG. 3A, the thickness of the hockey stick 1 is greatest at the handgrip 5 and gradually tapers along the length of the widened shaft portion 4 from the handgrip 5 toward the heel 7. The thickness of the handle 3 of the shaft 2, on the other hand, is preferably uniform, having a cross-sectional area 14, shown in FIG. 3B, less than the cross-sectional area 16 of the shaft 2 at the handgrip 5, shown in FIG. 3C. The greater thickness of the shaft 2 at the handgrip 5 increases the strength of the hockey stick 1 and provides for greater comfort of the grip.

Figure 4:
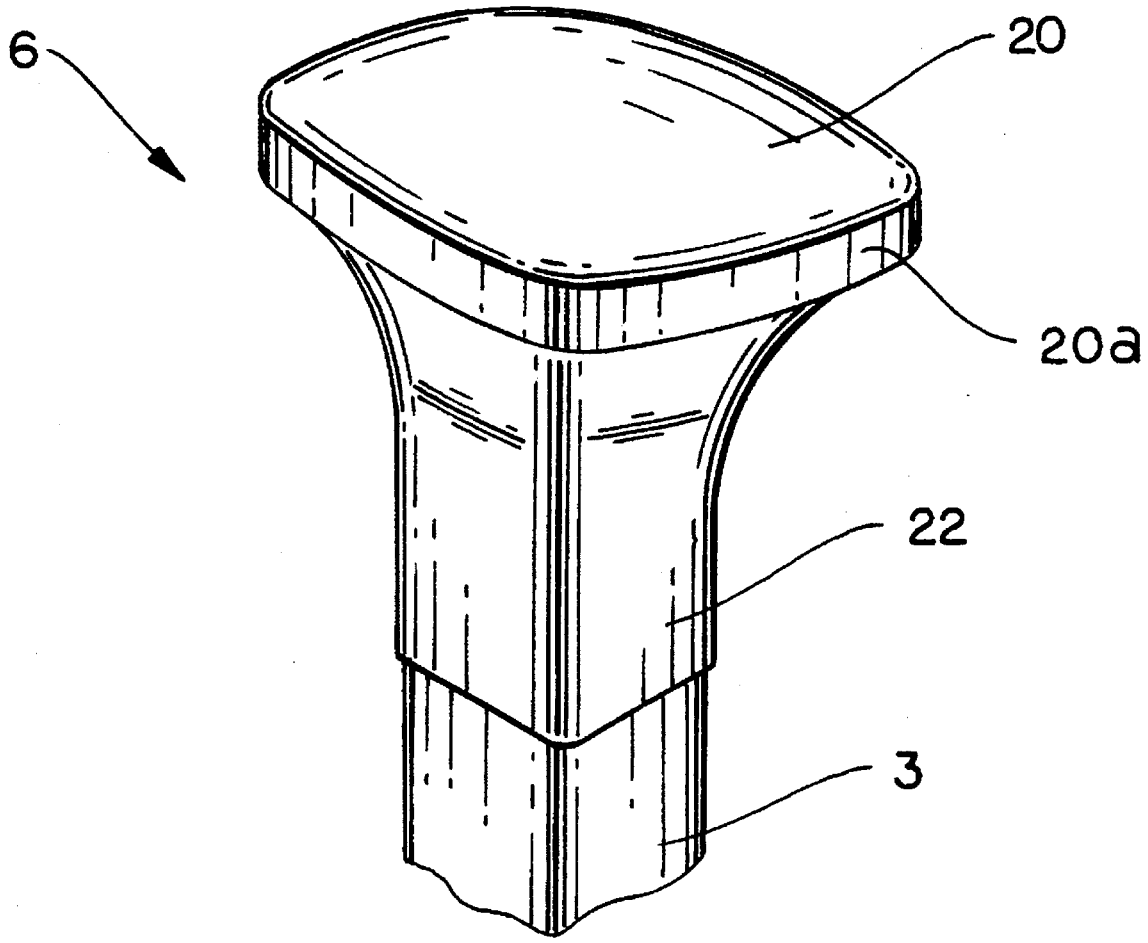
FIG. 4 is a perspective view of the endcap that attaches to the end of the shaft of the hockey stick according to the present invention.

An endcap 6 is attached to the end of the handle portion 3, as shown in FIGS. 1 and 4. The endcap 6 may have a general knob-like shape, with a wide end portion 20 tapering to a narrower attachment portion 22. The endcap 6 may be designed such that the outer dimensions of the attachment portion 22 are less than the inner dimensions of a small longitudinal bore formed in the end of the handle portion 3, so that the attachment portion 22 can be fit into the end of the shaft 2. Alternatively, the attachment portion 22 may be hollow so as to accommodate the end of the handle portion 3. Other attachment techniques will occur to those skilled in the art without departing from the scope of the invention. The endcap 6 may also be formed integrally with the handle 3, as desired.

The end portion 20 is preferably convex and is made of a comparatively soft material, such as urethane, whereas the attachment portion 22 may be rectangular in cross-section and made of a comparatively hard material. In a preferred embodiment, the weight of the endcap is such that, with the handgrip 5 as a fulcrum, it and the handle portion 3 substantially offset the weight of the blade 8 so that the hockey stick 1 is balanced around the handgrip 5.

In the preferred embodiment, the endcap 6 is provided with a stop portion 20*a* which protrudes in at least a direction substantially opposite to the direction of projection of the blade 8, and by a predetermined amount, substantially perpendicularly away from the adjacent edge of the handle portion 3. The length of the stop portion 20*a* is such that when the hockey stick 1 is held in a horizontal position against the playing surface, as depicted in FIG. 1, the lower edge 3*b* of handle portion 3 is substantially parallel to and spaced from the playing surface by the gap g. The gap g thus constitutes a measured distance between the lower edge of the handle portion 3 and the playing surface. The measured distance of the gap g is wide enough to accommodate the fingers of the goalie, thereby enabling the goalie to maintain a gloved grip on the full length of the shaft 2 when the hockey stick 1 is lowered to a horizontal position. Yet the gap g is sufficiently narrow so as to prevent a puck from sliding thereunder.

The hockey stick 1 may be graphically treated so that the blade 8 and part of the widened shaft portion 4 extending from the heel 7 toward the handgrip 5 are made of a light-colored material. The remaining portion of the shaft 2, including the handle portion 3, the handgrip 5, and the remaining part of the widened shaft portion 4, may be made of a dark-colored material. The graphic treatment is applied such that the transition from the dark-colored material to the light-colored material is gradual. This treatment creates a camouflage so that the visible position of the hockey stick 1 is indeterminate during play.

The above-described embodiment provides a goalie hockey stick 1 that is easy and comfortable to hold at both the handgrip 5 and along the handle portion 3 when the hockey stick is held in a horizontal position. The offset positioning of the handle portion 3 relative to the longitudinal axis of the widened shaft portion 4 brings the handle portion 3 closer to the playing surface than would otherwise be possible, yet the handle portion 3 remains sufficiently spaced therefrom to accommodate the gloved fingers of the goalie and still to prevent a puck from sliding thereunder. The endcap 6 maintains the measured distance g between the lower edge 3*b* of the handle portion 3 and the playing surface. The endcap 6 also serves to offset the weight of the blade 8, to prevent the hockey stick 1 from being easily dropped, and to enable the goalie to pick up the hockey stick 1 more easily. All of these features provide for an improved goalie hockey stick.

Having described the specific preferred embodiment of the present invention with reference to the accompanying drawings, it is to be understood that the invention is not limited to this precise embodiment, and that various changes and modifications may be effected therein by one skilled in the art without departing from the spirit or the scope of the present invention as defined in the appended claims.

What is claimed is:

1. A hockey stick for use by a goalie, comprising:

a blade;

a shaft attached to said blade at a heel and including a widened shaft portion extending from said heel and a narrow handle portion extending from said widened shaft portion to an end of said shaft; and a notched handgrip formed along a length of said shaft at a position between said widened shaft portion and said handle portion and having an ergonomic shape conforming to the shape of a hand including a thumb indentation and a plurality of adjacent finger notches formed opposite said thumb indentation, wherein said handgrip comprises an upwardly inclined upper surface area extending from an upper edge surface of said handle portion to a corresponding upper edge surface of said widened shaft portion for engagement with substantially the palm of a hand.

2. A hockey stick of claim 1 in which said thumb indentation is formed on an upper surface of said hockey stick and said plurality of adjacent finger notches are formed on a lower edge surface of said shaft.

3. A hockey stick of claim 2 in which a thickness of said shaft at said handgrip is greater than a thickness along a remaining portion of said shaft.

4. The hockey stick of claim 1 in which said thumb indentation is formed substantially along said upwardly inclined upper surface area and is substantially triangular in shape, having a widened portion along said inclined upper surface area and a rounded inner peak opposite said widened portion.

5. The hockey stick of claim 2 in which each of said finger notches is inwardly directed and formed along a portion of said lower edge surface of said shaft substantially opposite said inclined upper surface area, said portion of said lower edge surface being inclined generally downwardly from a lower edge surface of said handle portion to a corresponding lower edge surface of said widened shaft portion.

6. The hockey stick of claim 5 in which each of said finger notches is substantially V-shaped, defining a rounded inner peak portion such that a line tangential to said peak portions is substantially parallel to said downward inclined portion of said lower edge surface.

7. The hockey stick of claim 6 in which said rounded peak portions extend inwardly toward the center longitudinal axis of said widened shaft portion.

8. The hockey stick of claim 7 in which lines bisecting each of said finger notches tend to converge to a point in space beyond said upper edge surface of said shaft.

9. The hockey stick of claim 8 in which said plurality of finger notches comprises two finger notches.

10. The hockey stick of claim 4 in which said thumb indentation is a groove formed along one side surface area of said shaft.

11. The hockey stick of claim 2 in which at least one of said finger notches is substantially opposite said thumb indentation.

12. The hockey stick of claim 6 in which said line tangential to said peak portions of said finger notches is substantially parallel to a line bisecting said thumb indentation.

13. A hockey stick of claim 1 in which said blade and a first part of said widened shaft portion extending from said heel are of a light colored material, and wherein a second part of said widened shaft portion extending from said first part, together with said handgrip and said handle portion are of a dark colored material, and wherein a transition from said light colored material to said dark colored material is gradual.

14. A hockey stick for use by a goalie, comprising:

a blade: and a shaft attached to said blade at a heel and including a widened shaft portion extending from said heel and a narrow handle portion extending from said widened shaft portion to an end of said shaft, wherein the longitudinal axis of said handle portion is offset from the longitudinal axis of said widened shaft portion such that said longitudinal axis of said handle portion is closer to a playing surface than said longitudinal axis of said widened shaft portion and a lower edge of said handle portion is spaced by a predetermined distance from the playing surface when the hockey stick is held in a horizontal position against the playing surface.

15. A hockey stick of claim 14, further comprising an endcap located at said end of said shaft, wherein said endcap comprises an end portion and a stop portion protruding from said end portion in at least one direction beyond said lower edge of said handle portion by said predetermined distance, whereby said stop portion positions said lower edge of said handle portion above said playing surface engaged by said stop portion.

16. The hockey stick of claim 15 in which said endcap comprises an attachment portion formed of a hard material and said end portion is formed of a softer material.

17. The hockey stick of claim 15 in which a lower edge of said widened shaft portion is spaced from said lower edge of said handle portion in the same direction as said stop portion and by said predetermined distance.

18. The hockey stick of claim 17 in which said predetermined distance defines a gap between said lower edge of said handle portion and the playing surface when both said stop portion and said lower edge of said widened shaft portion engage the playing surface.

19. The hockey stick of claim 18 in which said predetermined distance is less than a thickness of a hockey puck.

* * * * *